US010089950B2

(12) United States Patent
Ito

(10) Patent No.: US 10,089,950 B2
(45) Date of Patent: Oct. 2, 2018

(54) ELECTRO-OPTICAL DEVICE, METHOD OF CONTROLLING ELECTRO-OPTICAL DEVICE, AND ELECTRONIC INSTRUMENT

(71) Applicant: Seiko Epson Corporation, Tokyo (JP)

(72) Inventor: Akihiko Ito, Tatsuno-machi (JP)

(73) Assignee: Seiko Epson Corporation, Tokyo (JP)

( * ) Notice: Subject to any disclaimer, the term of this patent is extended or adjusted under 35 U.S.C. 154(b) by 323 days.

(21) Appl. No.: 14/919,434

(22) Filed: Oct. 21, 2015

(65) Prior Publication Data

US 2016/0125820 A1 May 5, 2016

(30) Foreign Application Priority Data

Nov. 5, 2014 (JP) ..... 2014-224972

(51) Int. Cl.
*G09G 3/36* (2006.01)
*G09G 3/00* (2006.01)

(52) U.S. Cl.
CPC ..... *G09G 3/3685* (2013.01); *G09G 3/3622* (2013.01); *G09G 3/002* (2013.01); *G09G 2310/0251* (2013.01); *G09G 2310/0297* (2013.01); *G09G 2320/0233* (2013.01); *G09G 2320/0271* (2013.01)

(58) Field of Classification Search
None
See application file for complete search history.

(56) References Cited

U.S. PATENT DOCUMENTS 5,892,493 A * 4/1999 Enami ..... G09G 3/3688 345/100
5,959,600 A 9/1999 Uchino et al.
2004/0160393 A1 8/2004 Kato
2005/0041488 A1 2/2005 Ito et al.
2008/0117235 A1 5/2008 Morita
2009/0256826 A1* 10/2009 Asano ..... G09G 3/3233 345/204
2012/0038692 A1 2/2012 Ito
(Continued)

FOREIGN PATENT DOCUMENTS

JP H08-286639 A 11/1996
JP 2004-184643 A 7/2004
JP 2005-043418 A 2/2005
(Continued)

*Primary Examiner* — Amare Mengistu
*Assistant Examiner* — Sarvesh J Nadkarni
(74) *Attorney, Agent, or Firm* — ALG Intellectual Property, LLC

(57) ABSTRACT

An electro-optical device includes a data line driving circuit that supplies a video signal, in which a data voltage having magnitude of voltage applied to the data lines in the amount of k (k>1) in accordance with an input video divided into frames is subjected to time division multiplexing, to a signal line, a selection circuit that selects at least one data line which becomes a supply destination of the video signal supplied to the signal line, a scanning line driving circuit that selects at least one scanning line, a control circuit that controls a predetermined precharge voltage to be applied to the data lines in the amount of k in the precharge time period, and a correction circuit that corrects a gradation level difference between the pixel applied with the precharge voltage and the pixel applied with no precharge voltage.

16 Claims, 14 Drawing Sheets

(56) References Cited

U.S. PATENT DOCUMENTS

2012/0056917 A1 3/2012 Ito

FOREIGN PATENT DOCUMENTS

| | | | |
|---|---|---|---|
| JP | 2006-259224 | A | 9/2006 |
| JP | 3882796 | B | 11/2006 |
| JP | 2007-199448 | A | 8/2007 |
| JP | 2008-129029 | A | 6/2008 |
| JP | 4894151 | B | 1/2012 |
| JP | 2012-037827 | A | 2/2012 |
| JP | 2012-053407 | A | 3/2012 |

* cited by examiner

ELECTRO-OPTICAL DEVICE, METHOD OF CONTROLLING ELECTRO-OPTICAL DEVICE, AND ELECTRONIC INSTRUMENT

BACKGROUND

1. Technical Field

The present invention relates to an electro-optical device, a method of controlling an electro-optical device, and an electronic instrument.

2. Related Art

There is a known dot matrix display device which uses an electro-optical element such as liquid crystal element. There is provided a known technology in which a precharge voltage is applied to a pixel before writing data therein in order to improve display quality of the display devices. Meanwhile, in recent years, the display devices have achieved high resolution, and there is a demand for a high-speed operation of a driving circuit in driving of the display devices. JP-A-2012-53407 discloses a technology in which a time period for performing precharge is switched every horizontal time period, in a drive method adopting precharge.

In the case of JP-A-2012-53407, there is a possibility that writing of data is not normally performed during an initial writing time period in a time period without precharge compared to a time period with precharge due to a delay (a delay caused by a wiring delay or a load carrying capacity) inside an electro-optical device, leading to the occurrence of a gradation level difference between a pixel with precharge and a pixel without precharge.

SUMMARY

An advantage of some aspects of the invention is to provide a technology that reduces the gradation level difference between the pixel with precharge and the pixel without precharge.

According to an aspect of the invention, there is provided an electro-optical device including: a plurality of pixels that are provided so as to correspond to intersections of a plurality of scanning lines and a plurality of data lines, and present gradation levels in accordance with electrical potential of a corresponding data line when a corresponding scanning line is selected; a data line driving circuit that supplies a video signal, in which a data voltage having magnitude of voltage applied to the data lines in the amount of k (however, k>1) among the plurality of data lines in accordance with an input video divided into frames is subjected to time division multiplexing, to a signal line; a selection circuit that selects at least one data line which becomes a supply destination of the video signal supplied to the signal line among the data lines in the amount of k; a scanning line driving circuit that selects at least one scanning line among the plurality of scanning lines; a control circuit that controls the selection circuit so as to select all the data lines in the amount of k in a precharge time period before the data voltage in accordance with the video signal subjected to time division multiplexing is applied during a time period in which the scanning line corresponding to a particular pixel is selected in one frame, and controls a predetermined precharge voltage to be applied to the data lines in the amount of k in the precharge time period; and a correction circuit that corrects a gradation level difference between the pixel applied with the precharge voltage and the pixel applied with no precharge voltage.

In this case, the gradation level difference between the pixel with precharge and the pixel without precharge can be reduced.

In the electro-optical device, the correction circuit may change a correction amount in correction in accordance with the data voltage applied to the pixel which becomes a correction target.

In this case, compared to a case where the correction amount is determined without depending on the data voltage, the gradation level difference between the pixel with precharge and the pixel without precharge can be reduced further.

In the electro-optical device, the correction circuit may increase the correction amount in a case where a difference between the data voltage of the pixel which becomes the correction target and the precharge voltage is a second voltage compared to in a case where the difference therebetween is a first voltage (however, the second voltage is greater than the first voltage).

In this case, compared to the case where the correction amount is determined without depending on the difference between the data voltage and the precharge voltage, the gradation level difference between the pixel with precharge and the pixel without precharge can be reduced further.

In the electro-optical device, the correction circuit may perform correction so as to reduce the data voltage of the pixel applied with the precharge voltage and to increase the data voltage of the pixel applied with no precharge voltage.

In this case, compared to a case where the data voltage of only one between the pixel with precharge and the pixel without precharge is corrected, the gradation level difference between the pixel with precharge and the pixel without precharge can be reduced further.

In the electro-optical device, the correction circuit may perform correction with respect to the pixel in which polarities of the precharge voltage and the data voltage are different from each other, and perform no correction with respect to the pixel in which the polarities of the precharge voltage and the data voltage are the same as each other.

In the electro-optical device, the correction circuit may perform correction so as to increase the data voltage of the pixel applied with the precharge voltage and reduce the data voltage of the pixel applied with no precharge voltage.

In this case, compared to the case where the data voltage of only one between the pixel with precharge and the pixel without precharge is corrected, the gradation level difference between the pixel with precharge and the pixel without precharge can be reduced further.

In the electro-optical device, the control circuit may switch an arrangement of the particular pixel every frame.

In this case, compared to a case where the arrangement of a particular pixel is not switched every frame, the gradation level difference between the pixel with precharge and the pixel without precharge can be difficult to be visually recognized.

According to another aspect of the invention, there is provided a method of controlling an electro-optical device which includes a plurality of pixels that are provided so as to correspond to intersections of a plurality of scanning lines and a plurality of data lines, and present gradation levels in accordance with electrical potential of a corresponding data line when a corresponding scanning line is selected, the method including: supplying a video signal, in which a data voltage having magnitude of voltage applied to the data lines in the amount of k (however, k>1) among the plurality of data lines in accordance with an input video divided into frames is subjected to time division multiplexing, to a signal line; selecting at least one data line which becomes a supply destination of the video signal supplied to the signal line among the data lines in the amount of k; selecting at least one scanning line among the plurality of scanning lines; controlling the selection circuit so as to select all the data lines in the amount of k in a precharge time period before the data voltage in accordance with the video signal subjected to time division multiplexing is applied during a time period in which the scanning line corresponding to a particular pixel is selected in one frame, and controlling a predetermined precharge voltage to be applied to the data lines in the amount of k in the precharge time period; and correcting a gradation level difference between the pixel applied with the precharge voltage and the pixel applied with no precharge voltage.

In this case, the gradation level difference between the pixel with precharge and the pixel without precharge can be reduced.

According to still another aspect of the invention, there is provided an electronic instrument including any one of the electro-optical devices described above.

In this case, the gradation level difference between the pixel with precharge and the pixel without precharge can be reduced.

BRIEF DESCRIPTION OF THE DRAWINGS

The invention will be described with reference to the accompanying drawings, wherein like numbers reference like elements.

DESCRIPTION OF EXEMPLARY EMBODIMENTS

1. Configuration

Figure 1:
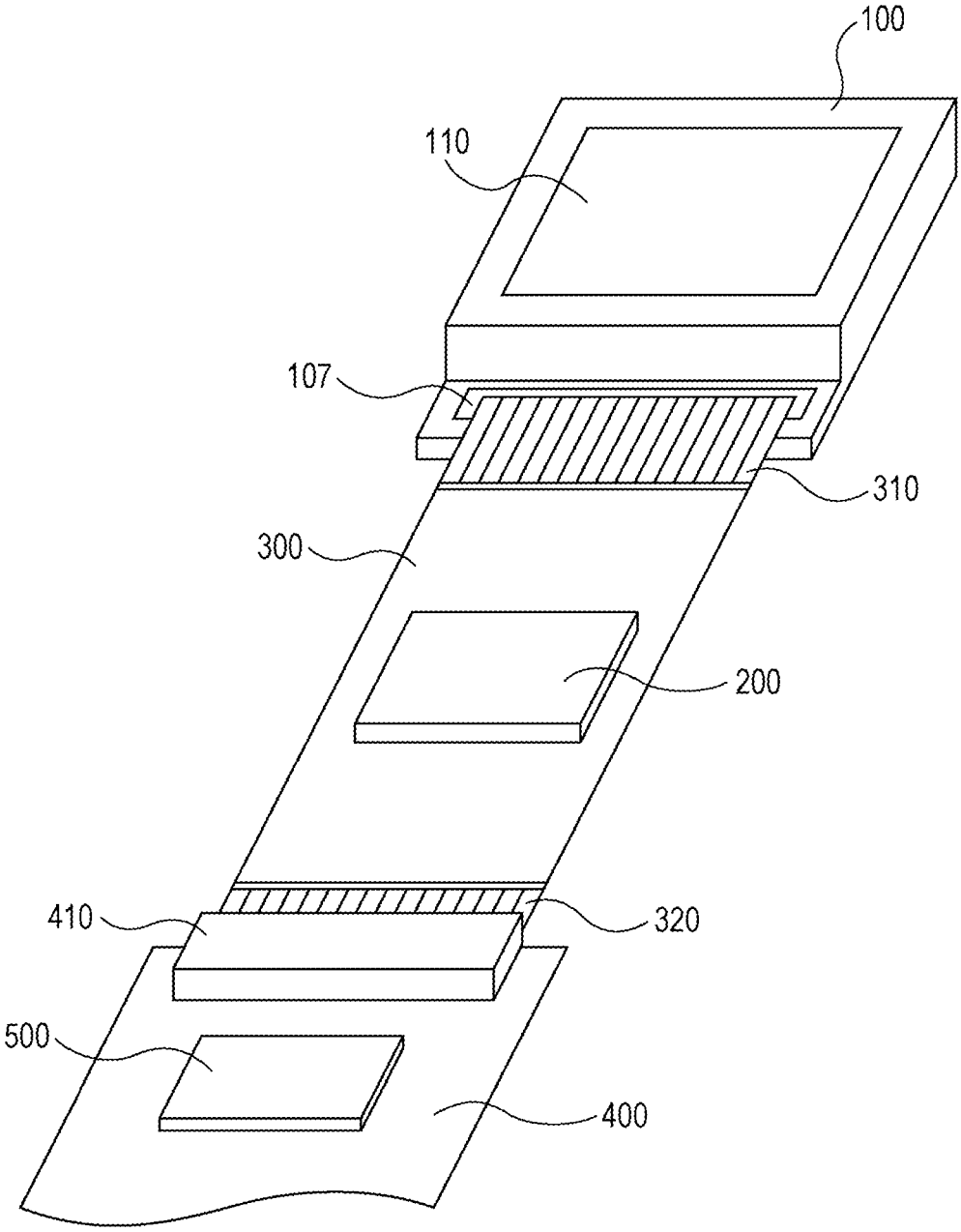
FIG. 1 is a diagram illustrating the appearance of an electro-optical device in an embodiment.

FIG. 1 is a diagram illustrating the appearance of an electro-optical device 1 in an embodiment. For example, the electro-optical device 1 is a liquid crystal device which is used as a light bulb in a projector. The electro-optical device 1 includes a liquid crystal panel 100, a data line driving circuit 200, a flexible printed circuit (FPC) substrate 300, a circuit board 400, and a control circuit 500. The data line driving circuit 200 is provided on the FPC substrate 300. The control circuit 500 for controlling the electro-optical device 1 is provided on the circuit board 400. The circuit board 400 and the liquid crystal panel 100 are electrically connected to each other via the FPC substrate 300. The circuit board 400 and the FPC substrate 300 are connected to each other via a connector 410 and a connector 320. The FPC substrate 300 and the liquid crystal panel 100 are connected to each other via a connector 310 and a connector 107. The electro-optical device 1 operates in accordance with a signal which is supplied from a host apparatus (not illustrated).

Figure 2:
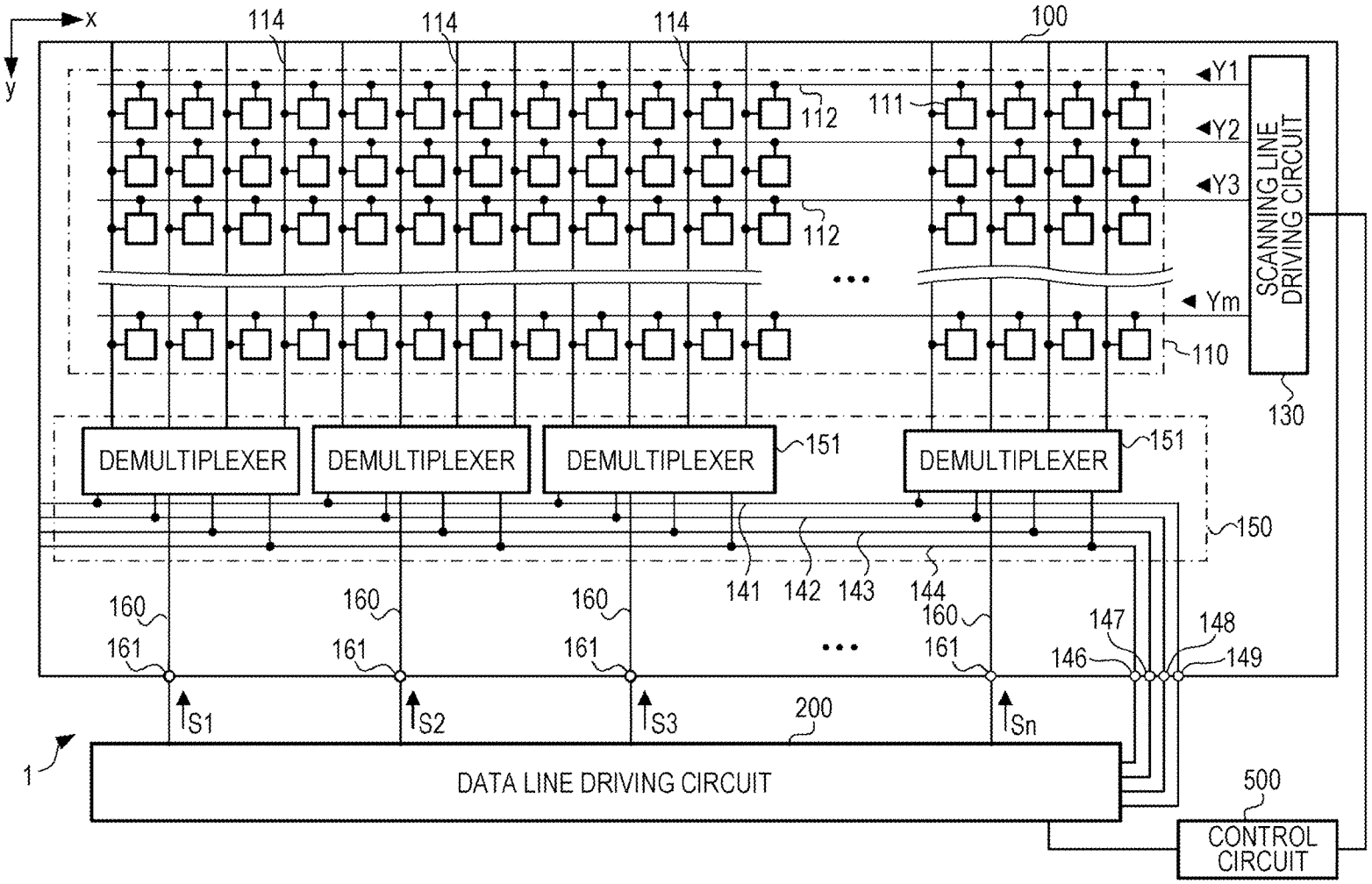
FIG. 2 is a schematic diagram illustrating a configuration of the electro-optical device.

FIG. 2 is a schematic diagram illustrating a configuration of the liquid crystal panel 100, particularly the electro-optical device 1. The data line driving circuit 200 outputs a video signal which carries an image to be displayed on the liquid crystal panel 100, in response to a clock signal, a control signal, and a video signal which are input from the control circuit 500. The liquid crystal panel 100 displays the image in response to clock signals and video signals which are input from the data line driving circuit 200 and other circuits.

The liquid crystal panel 100 includes a pixel area 110, a scanning line driving circuit 130, a data line selection circuit 150, video signal lines 160 in the amount of n, video signal input terminals 161 in the amount of n, selection signal lines in the amount of k (a selection signal line 141, a selection signal line 142, a selection signal line 143, and a selection signal line 144; in the example of FIG. 2, k=4), and selection control signal input terminals in the amount of k (a selection control signal input terminal 146, a selection control signal input terminal 147, a selection control signal input terminal 148, and a selection control signal input terminal 149).

The pixel area 110 is an area for displaying an image. The pixel area 110 includes scanning lines 112 in the amount of m, data lines 114 in the amount of (k×n), and pixels 111 in the amount of (m×k×n). The scanning lines 112 are signal lines for transmitting a scanning signal and are provided along a row (x) direction. The data lines 114 are signal lines for transmitting a data signal and are provided along a column (y) direction. The scanning lines 112 and the data lines 114 are electrically insulated from each other. The pixels 111 are provided so as to correspond to intersections of the scanning lines 112 and the data lines 114 when the liquid crystal panel 100 is seen in a z-direction (a direction perpendicular to the x-direction and the y-direction). In other words, the pixels 111 are arrayed in the matrix of m-row×(k×n)-column. In this example, the pixels 111 in the amount of k form one pixel group (a block) continuously in a row direction. The pixels 111 which belong to a certain block are connected to the same video signal line 160 via the data line selection circuit 150. In other words, the liquid crystal panel 100 has the pixel group which is divided into the blocks in the amount of n. Detailed descriptions of the pixels 111 will be given later. In the following descriptions, when a plurality of the scanning lines 112 need to be individually distinguished, it will be referred to as the scanning line 112 in the first row, the second row, the third row, or so on to the mth row. When each of a plurality of the data lines 114 needs to be individually distinguished, it will be referred to as the data line 114 in the first column, the second column, the third column, or so on to the (k×n)th column. The video signal lines 160 will be referred to in the similar manner.

The scanning line driving circuit 130 selects a row where data is written, from the plurality of pixels 111 arranged in the matrix. Specifically, the scanning line driving circuit 130 outputs a scanning signal for selecting one scanning line 112 from the plurality of scanning lines 112. The scanning line driving circuit 130 supplies scanning signals Y1, Y2, Y3, and so on to Ym to the scanning lines 112 in the first row, the second row, the third row, and so on to the mth row. In this example, the scanning signals Y1, Y2, Y3, and so on to Ym are the signals to be in a high level at a sequentially exclusive manner.

The selection signal line 141, the selection signal line 142, the selection signal line 143, and the selection signal line 144 are signal lines for transmitting selection signals SEL [1], SEL [2], SEL [3], and SEL [4] which are input from the selection control signal input terminal 146, the selection control signal input terminal 147, the selection control signal input terminal 148, and the selection control signal input terminal 149. The selection signals SEL [1], SEL [2], SEL [3], and SEL [4] are signals to be at a high level in a sequential manner.

The data line selection circuit 150 selects a column where data is written in each block. Specifically, the data line selection circuit 150 selects at least one data line 114 from the data lines 114 in the amount of k which belong to the block in accordance with the selection signals SEL [1], SEL [2], SEL [3], and SEL [4]. The data line selection circuit 150 includes demultiplexers 151 in the amount of n corresponding to each thereof in the pixel group in the n-column. Detailed descriptions of the demultiplexers 151 will be given later.

The video signal lines 160 are signal lines for transmitting a video signal S, which is input from the video signal input terminal 161, to the data line selection circuit 150. The video signal S is a signal indicating the data to be written in the pixels 111. Here, the term "video" denotes a still image or a moving image. One video signal line 160 is connected to the data lines 114 in the amount of k via the data line selection circuit 150. Therefore, in the video signal S, data supplied to the data lines 114 in the amount of k is subjected to time division multiplexing.

The data line driving circuit 200 outputs the video signals S1, S2, S3, and so on to Sn to the video signal input terminals 161 in the first column, the second column, the third column, and so on to the nth column. The data line driving circuit 200 outputs the selection signals SEL [1], SEL [2], SEL [3], and SEL [4] to the selection control signal input terminal 146, the selection control signal input terminal 147, the selection control signal input terminal 148, and the selection control signal input terminal 149.

Figure 3A:
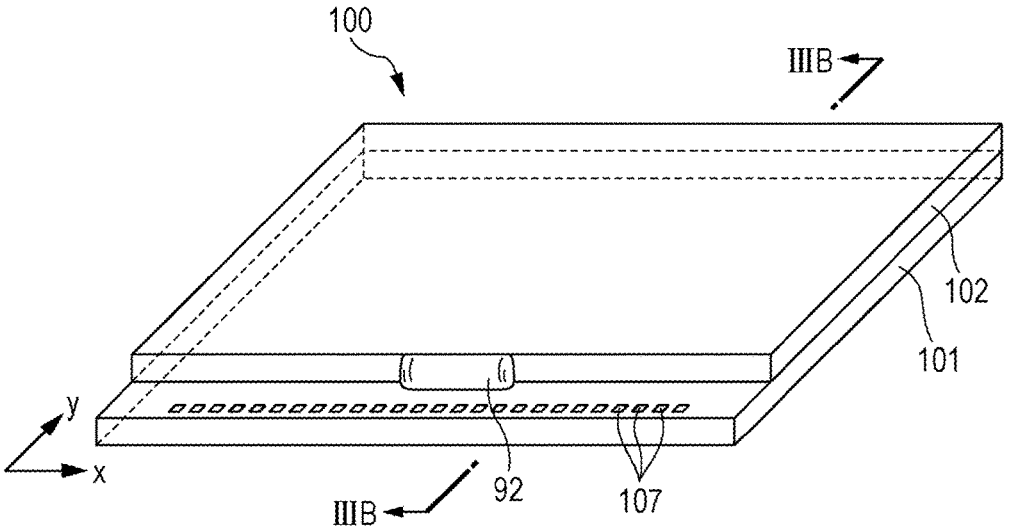
FIGS. 3A and 3B are diagrams illustrating a structure of a liquid crystal panel.
Figure 3B:
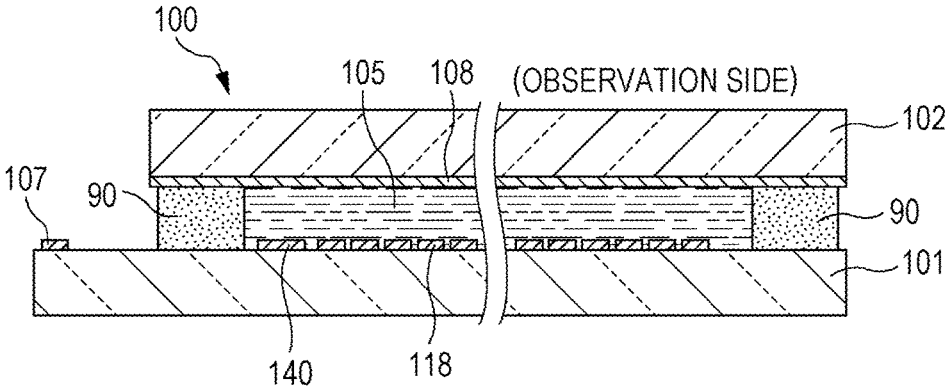

FIG. 3A is a perspective view illustrating a structure of the liquid crystal panel 100. FIG. 3B is a schematic diagram illustrating a section taken along line IIIB-IIIB in FIG. 3A. The liquid crystal panel 100 includes an element substrate 101, a counter substrate 102, and a liquid crystal 105. The element substrate 101 and the counter substrate 102 maintain a uniform aperture by using a sealing member 90 which includes a spacer (not illustrated), and are bonded so as to cause the electrode forming surfaces thereof to face each other. The liquid crystal 105 is sealed in the gap. The liquid crystal 105 is a vertical alignment-type (VA) liquid crystal, for example.

The element substrate 101 and the counter substrate 102 respectively include substrates having transparency, such as glass and quartz. The element substrate 101 is longer in size in the y-direction than that of the counter substrate 102. Since the inner side (the h-side) is aligned, one side on the front side (the H-side) of the element substrate 101 protrudes from the counter substrate 102. A plurality of the connectors 107 are provided in the protruding area along the x-direction. The plurality of connectors 107 are connected to the FPC substrate 300. The data line driving circuit 200 is formed in the FPC substrate 300. The plurality of connectors 107 are terminals for supplying various signals, various voltages, the video signals, and the like from external circuits. The plurality of connectors 107 include the selection control signal input terminal 146, the selection control signal input terminal 147, the selection control signal input terminal 148, the selection control signal input terminal 149, and the video signal input terminal 161 which are described above.

In the element substrate 101, a pixel electrode 118 is formed on a surface which faces the counter substrate 102. The pixel electrode 118 is subjected to patterning with a conductive layer having transparency, such as indium tin oxide (ITO). The scanning line driving circuit 130 is formed in the element substrate 101. In the counter substrate 102, a common electrode 108 provided on a surface which faces the element substrate 101 is the conductive layer having transparency similar to that of ITO.

Figure 4:
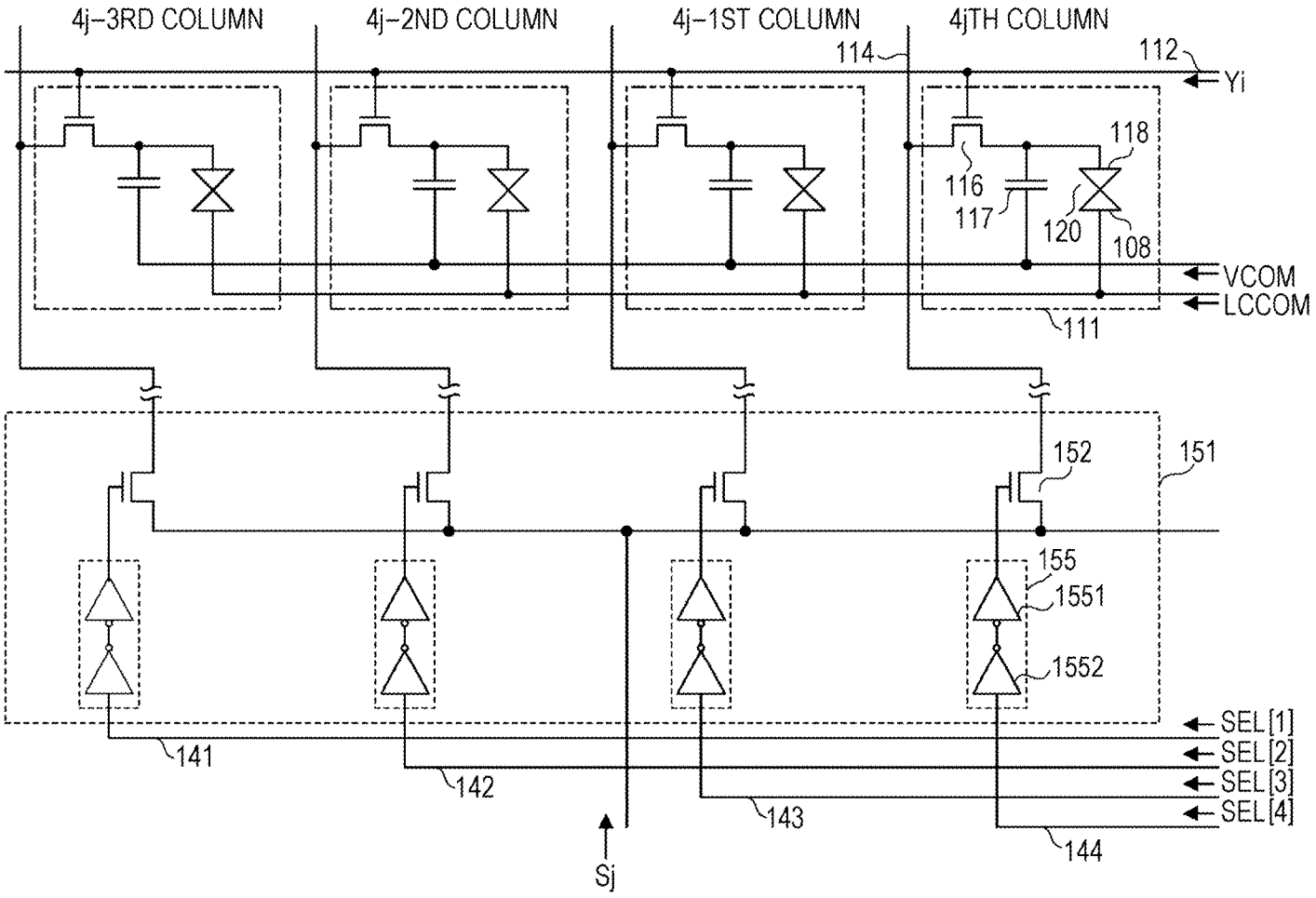
FIG. 4 is a diagram illustrating an equivalent circuit of a pixel.

FIG. 4 is a diagram illustrating an equivalent circuit of the pixels 111. FIG. 4 illustrates the demultiplexers 151 corresponding to the pixels 111 in the (4j−1)th column to the 4jth column in the ith row (i and j are integers satisfying $1 \leq i \leq m$ and $1 \leq j \leq n$). In the ith row, one block is configured with the pixels 111 in the amount of k (in this example, k=4). Each pixel 111 includes a thin film transistor (TFT) 116, the pixel electrode 118, a liquid crystal layer 120, the common electrode 108, and a retention volume 117. The TFT 116 is a switching element for controlling writing of data (applying of a voltage) with respect to the pixel electrode 118. In this example, the TFT 116 is an n-channel-type field effect transistor. A gate electrode of the TFT 116 is connected to the scanning line 112, a source electrode is connected to the data line 114, and a drain electrode is connected to the pixel electrode 118. When the scanning signal at a high level is supplied to the scanning line 112, the TFT 116 is in an ON state, and the data line 114 and the pixel electrode 118 are in low impedance states. In other words, data is written in the pixel electrode 118. When the scanning signal at a low level is supplied to the scanning line 112, the TFT 116 is in an OFF state, and the data line 114 and the pixel electrode 118 are in high impedance states. The common electrode 108 is common in all the pixels 111. For example, a common voltage LCCOM is applied to the common electrode 108 through the data line driving circuit 200. The liquid crystal layer 120 is applied with a voltage corresponding to an electrical potential difference between the pixel electrode 118 and the common electrode 108, and optical properties (reflectivity or transmissivity) thereof vary in accordance with the voltage. The retention volume 117 is connected to the liquid crystal layer 120 in parallel and retains an electrical charge corresponding to an electrical potential difference between the pixel electrode 118 and a common voltage VCOM (in this example, VCOM=LCCOM). Hereinafter, when the pixels 111 need to be individually distinguished in a particular block, the pixel 111 will be distinguished by being referred to as the pixel 111 [s] (s is an integer satisfying $1 \leq s \leq k$). The factors such as the TFT 116 included in the pixel 111 are similarly distinguished.

The demultiplexer 151 is a circuit for supplying the video signal S to the data line 114 which is selected in accordance with the selection signals SEL [1] to SEL [4]. The demultiplexer 151 includes one video signal input terminal, the selection control signal input terminals in the amount of k, video signal output terminals in the amount of k, and TFTs 152 in the amount of k (in this example, k=4). The TFT 152 is the switching element for selecting the data line 114 in accordance with the selection signal SEL which is input to a gate.

The gate electrode of a TFT 152 [1] is connected to the selection signal line 141, the source electrode is connected to the video signal line 160 in the jth column, and the drain electrode is connected to the data line 114 in the (4j−3)th column (that is, the source electrode of a TFT 116 [1] of the pixel group in the jth column). When a selection signal SEL [1] at a high level is supplied to the selection signal line 141, the TFT 152 is in the ON state, and the video signal line 160 in the jth column and the data line 114 in the (4j−3)th column are in low impedance states. In other words, a video signal Sj is supplied to the data line 114 in the (4j−3)th column. When the selection signal SEL [1] at a low level is supplied to the selection signal line 141, the TFT 152 [1] is in the OFF state, and the video signal line 160 in the jth column and the data line 114 in the (4j−3)th column are in high impedance states.

The gate electrode of a TFT 152 [2] is connected to the selection signal line 142, the source electrode is connected to the video signal line 160 in the jth column, and the drain electrode is connected to the data line 114 in the (4j−2)th column (that is, the source electrode of a TFT 116 [2] of the pixel group in the jth column). When a selection signal SEL [2] at a high level is supplied to the selection signal line 142, the TFT 152 [2] is in the ON state, and the video signal line 160 in the jth column and the data line 114 in the (4j−2)th column become conductive with respect to each other. In other words, the video signal Sj is supplied to the data line 114 in the (4j−2)th column. When the selection signal SEL [2] at a low level is supplied to the selection signal line 142, the TFT 152 [2] is in the OFF state, and the video signal line 160 in the jth column and the data line 114 in the (4j−2)th column are in high impedance states.

The gate electrode of a TFT 152 [3] is connected to the selection signal line 143, the source electrode is connected to the video signal line 160 in the jth column, and the drain electrode is connected to the data line 114 in the (4j−1)th column (that is, the source electrode of a TFT 116 [3] of the pixel group in the jth column). When a selection signal SEL [3] at a high level is supplied to the selection signal line 143, the TFT 152 [3] is in the ON state, and the video signal line 160 in the jth column and the data line 114 in the (4j−1)th column become conductive with respect to each other. In other words, the video signal Sj is supplied to the data line 114 in the (4j−1)th column. When the selection signal SEL [3] at a low level is supplied to the selection signal line 143, the TFT 152 [3] is in the OFF state, and the video signal line 160 in the jth column and the data line 114 in the (4j−1)th column are in high impedance states.

The gate electrode of a TFT 152 [4] connected to the selection signal line 144, the source electrode is connected to the video signal line 160 in the jth column, and the drain electrode is connected to the data line 114 in the 4jth column (that is, the source electrode of a TFT 116 [4] of the pixel group in the jth column). When a selection signal SEL [4] at a high level is supplied to the selection signal line 144, the TFT 152 [4] is in the ON state, and the video signal line 160 in the jth column and the data line 114 in the 4jth column become conductive with respect to each other. In other words, the video signal Sj is supplied to the data line 114 in the 4jth column. When the selection signal SEL [4] at a low level is supplied to the selection signal line 144, the TFT 152 [4] is in the OFF state, and the video signal line 160 in the jth column and the data line 114 in the 4jth column are in high impedance states.

The video signal S input from the video signal input terminal 161 is supplied to the demultiplexer 151 via the video signal line 160. In the demultiplexer 151, the video signal line 160 branches off in multiple numbers among the TFTs 152 [1] to [4]. In this example, the demultiplexer 151 includes a waveform shaping circuit 155. The waveform shaping circuit 155 may be omitted.

Figure 5:
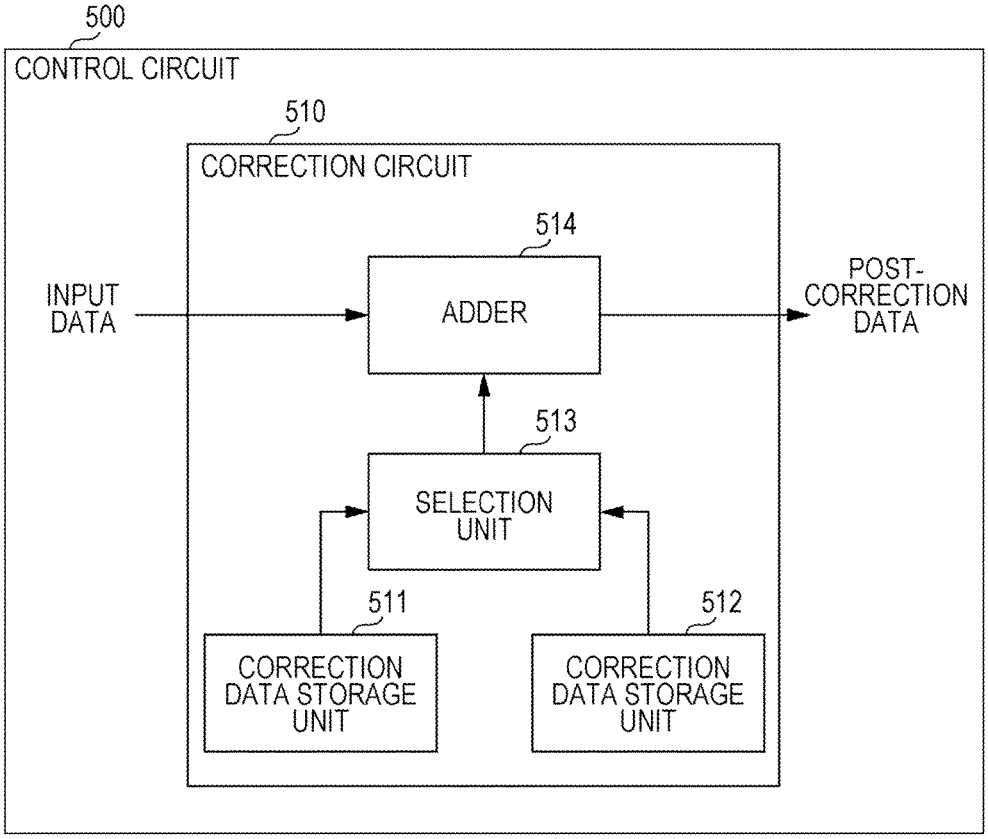
FIG. 5 is a diagram exemplifying a configuration of a control circuit.

FIG. 5 is a diagram exemplifying a configuration of the control circuit 500. The control circuit 500 includes a correction circuit 510. The control circuit 500 also includes circuits other than the correction circuit 510 such as the circuit for generating and outputting the control signal with respect to the scanning line driving circuit 130 and the data line driving circuit 200. However, in this case, other circuits except for the correction circuit 510 are omitted. The correction circuit 510 is a circuit for correcting a gradation level difference between the pixel 111 in which precharge is performed and the pixel 111 in which no precharge is performed. The correction circuit 510 includes a correction data storage unit 511, a correction data storage unit 512, a selection unit 513, and an adder 514. The correction data storage unit 511 stores a correction value with respect to the pixel in which no precharge is performed. The correction data storage unit 512 stores a correction value with respect to the pixel in which precharge is performed. The selection unit 513 selects any one of the correction values of the correction data storage unit 511 and the correction data storage unit 512. The adder 514 performs addition or subtraction of correction data selected by the selection unit 513, with respect to input video data. The video data input to the correction circuit 510 is data indicating a voltage value which is applied to the pixel electrode 118. Otherwise, the video data input to the correction circuit 510 may be data indicating a gradation level value which the pixel 111 is caused to display.

In brief, the plurality of pixels 111 are provided so as to correspond to the intersections of the plurality of scanning lines 112 and the plurality of data lines 114, and present gradation levels in accordance with electrical potential of the corresponding data line 114 when the corresponding scanning line 112 is selected. The data line driving circuit 200 supplies the video signal, in which a data voltage having magnitude of voltage applied to the data lines in the amount of k (however, k>1) among the plurality of data lines 114 in accordance with the input video divided into frames is subjected to time division multiplexing, to the signal line. The data line selection circuit 150 selects at leasgradation level data line 114 which becomes a supply destination of the video signal supplied to the signal line among the data lines 114 in the amount of k. The scanning line driving circuit 130 selects at leasgradation level scanning line 112 among the plurality of scanning lines 112. The control circuit 500 controls the data line selection circuit 150 so as to select all the data lines in the amount of k in a precharge time period before the data voltage in accordance with the video signal subjected to time division multiplexing is applied during a time period in which the scanning line 112 corresponding to a particular pixel 111 is selected in one frame, and controls a predetermined precharge voltage to be applied to the data lines 114 in the amount of k in the precharge time period. The correction circuit 510 corrects a gradation level difference between the pixel 111 applied with the precharge voltage and the pixel 111 applied with no precharge voltage.

2. Operation 2-1. Overview

Figure 6:
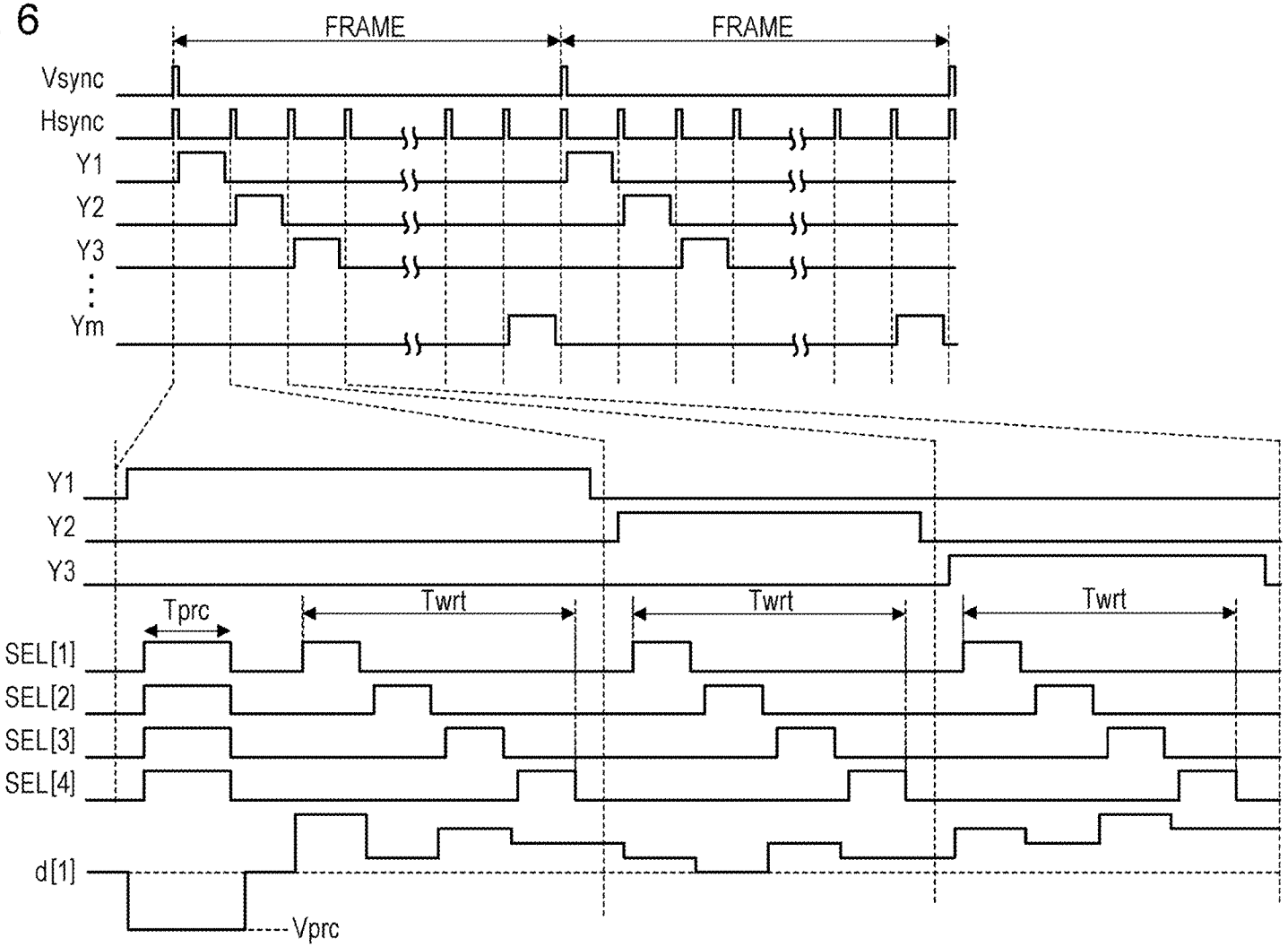
FIG. 6 is a timing chart illustrating an operation of the electro-optical device according to a related technology.

FIG. 6 is a timing chart illustrating an operation of the electro-optical device according to a related technology. A vertical synchronizing signal Vsync indicates timing of vertical synchronizing, that is, a starting time of the frame. The polarity of the data voltage which is subjected to time division multiplexing in the video signal is inverted every frame. In other words, in this example, a drive method of the electro-optical device is a so-called frame inversion drive. A horizontal synchronizing signal Hsync indicates timing of horizontal synchronizing, that is, timing of switching the scanning line 112 to be selected. In this example, the duration of horizontal time periods is not uniform but rather fluctuates due to the below-described reason. In this example, the scanning signals Y1 to Ym are signals for selecting the scanning lines 112 one at a time in a sequentially exclusive manner.

Each horizontal time period includes a time period (hereinafter, referred to as "a writing time period Twrt") in which data is sequentially written in the data lines 114 included in one block. The writing time period Twrt includes a time period for sequentially selecting one data line 114 which supplies data, from the data lines 114 in the amount of k in each block.

The horizontal time periods partially include a precharge time period Tpre. The precharge time period is a time period for performing precharge. The term "precharge" denotes that the data lines 114 (and liquid crystals 115) are charged (or discharged) in advance in order to compensate for writing deficiency (ending of voltage applying before the liquid crystal 115 reaches a desired optical state) during the writing time period. Within the precharge time period Tpre, all the data lines 114 are simultaneously selected, and precharge electrical potential Vpre are applied thereto. From the view point of display quality, it is preferable to perform precharge in the overall horizontal time periods. However, in this example, in order to reduce consumption electricity, or in order to improve the drive speed, precharge is not performed in the overall horizontal time periods, whereas precharge is performed partially only in the horizontal time periods. In other words, when taking a look at a certain frame, precharge is not performed with respect to the overall pixels 111, but precharge is performed with respect to only the pixels 111 in partial rows. In the example of FIG. 6, precharge is performed every four horizontal time period. In other words, precharge is performed in only one horizontal time period among the four continuous horizontal time periods, and precharge is not performed in the remaining horizontal time periods.

In this example, the precharge electrical potential Vpre retains negative polarity at all times without depending on the polarity of the data voltage in the frame. The reason is as follows. For example, parasitic capacitance exists between the data line 114 and the pixel electrode 118. Due to capacitive coupling caused by the parasitic capacitance, fluctuation of the electrical potential in the data line 114 affects the electrical potential in the pixel electrode 118. In a case of a so-called 1H-inversion drive in which polarity of the data voltage is inverted every horizontal time period, the influence is cancelled every 1H, thereby being difficult to be visually recognized. However, in the frame inversion drive, the influence lasts for one frame, thereby being easy to be visually recognized as a flicker. In order to solve such a disadvantage, precharge of the electrical potential of negative polarity is performed at all times without depending on the polarity of the data voltage.

However, in the example of FIG. 6, precharge is performed in only one horizontal time period among the four continuous horizontal time periods. In other words, in one frame, precharge is performed with respect to only the pixels 111 in one row among the four continuous rows of the pixels 111, and precharge is not performed with respect to the remaining three rows of the pixels 111. Here, precharge which is performed with respect to only partial rows is referred to as "thinning precharge".

In thinning precharge, there is a disadvantage in that a gradation level difference may occur between the row with precharge and the row without precharge. The reason for a difference occurring in gradation level may vary depending on the specific configuration of the liquid crystal panel 100 and the data line driving circuit 200, and two representative reasons will be described herein.

Figure 7:
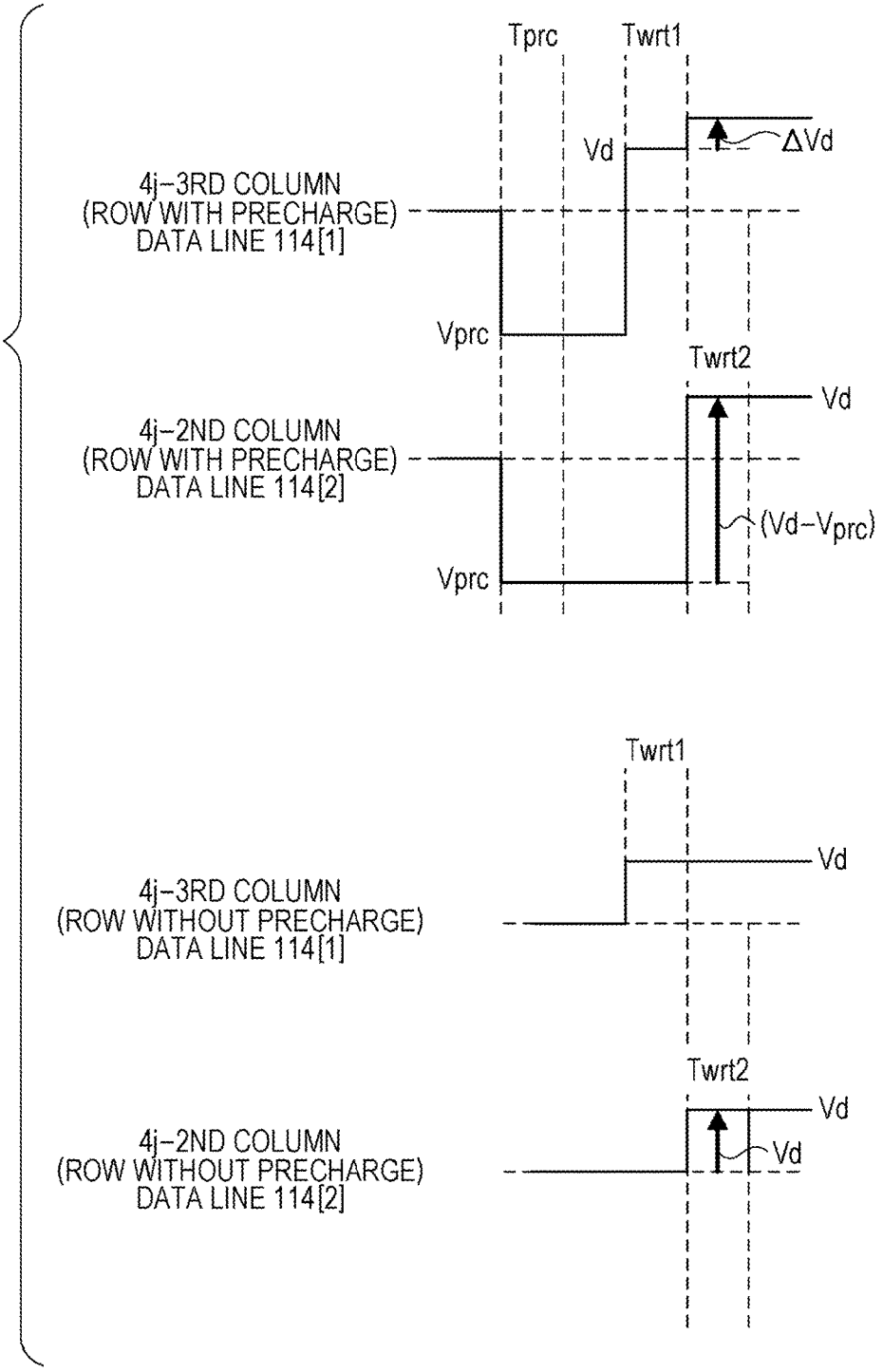
FIG. 7 is a diagram illustrating a reason for an occurrence of a gradation level difference.

FIG. 7 is a diagram illustrating the reason for an occurrence of the gradation level difference. The upper half in FIG. 7 is a diagram illustrating electrical potential of the two pixel electrodes 118 which are connected to two adjacent data lines 114 (in the (4j−3)th column and the (4j−2)th column) in the row with precharge. Within a precharge time period Tprc, precharge electrical potential Vprc is written in the two data lines 114. In this example, Vprc<0. When the precharge time period Tprc ends, all the TFTs 152 are in OFF states. Thereafter, the TFT 152 [1] is in the ON state during a writing time period Twrt 1, and a data voltage Vd is applied to a data line 114 [1]. When the writing time period Twrt 1 ends, the TFT 152 [1] is in the OFF state. Subsequently, the TFT 152 [2] is in the ON state during a writing time period Twrt 2, and the data voltage Vd is applied to a data line 114 [2]. In this case, since the electrical potential of a pixel electrode 118 [2] is raised from Vprc to Vd in the data line 114 [2], large quantity of electrical charge flows in. Here, the data line 114 [1] is in capacitive coupling with the data line 114 [2] via the parasitic capacitance. Therefore, in accordance with a rise of the electrical potential in the data line 114 [2], the data line 114 [1], that is, the electrical potential of a pixel electrode 118 [1] rises slightly (ΔVd in the diagram). Meanwhile, as illustrated in the lower half in FIG. 7, in the row without precharge, an electrical charge for raising the electrical potential of the pixel electrode 118 [2] from zero V to Vd flows in the data line 114 [2] during the writing time period Twrt 2. However, the quantity of the electrical charge thereof is small compared to that in the row with precharge, and there is scarcely any rise of the electrical potential in the data line 114 [1] due to capacitive coupling via the parasitic capacitance. Regarding the row without precharge, the electrical potential of the pixel electrode 118 before the writing time period Twrt is not limited to zero V, but descriptions are given herein with zero V for simplification.

Therefore, even though the data voltage during the writing time period is the same, the ultimate electrical potential of the pixel electrode 118 [1] is higher in the row with precharge. In other words, the gradation level of the pixel 111 with precharge is brighter than that of the pixel 111 without precharge. Here, only the two adjacent data lines 114 are described for simplification. However, the same phenomenon can occur in all the data lines 114.

Figure 8:
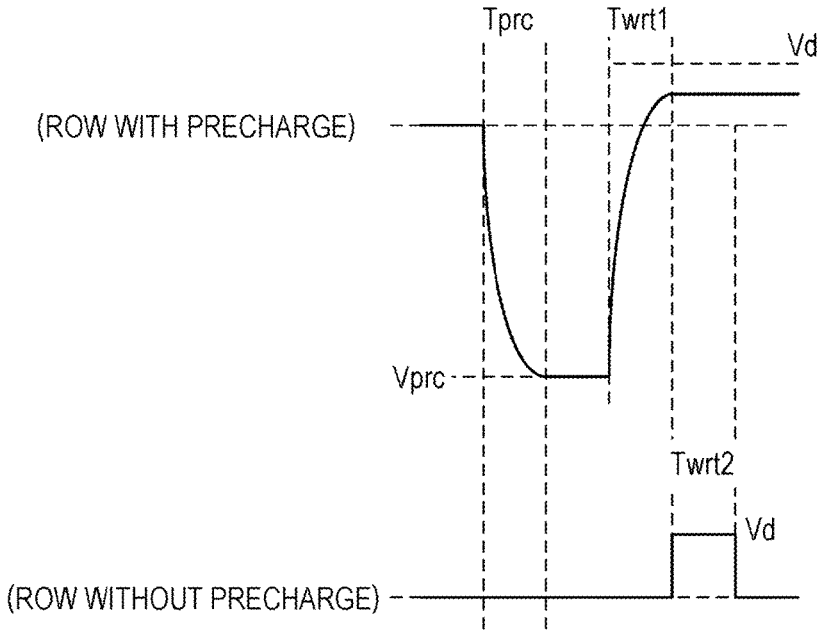
FIG. 8 is a diagram illustrating another reason for the occurrence of the gradation level difference.

FIG. 8 is a diagram illustrating another reason for the occurrence of a gradation level difference. In this example, ability of the data line driving circuit 200 (ability to supply an electrical charge) is relatively low, and it takes a long time period of time for the pixel electrode 118 to reach the desired electrical potential. In this example, in the row with precharge, since the ability of the data line driving circuit 200 is insufficient, the electrical potential of the pixel electrode 118 during the writing time period Twrt 1 cannot be raised from Vprc to Vd. Meanwhile, in the row without precharge, since the electrical potential of the pixel electrode 118 at the starting time of the writing time period Twrt 1 is closer to zero V than Vprc, the electrical potential of the pixel electrode 118 becomes Vd at the ending time of the writing time period Twrt 1.

Therefore, even though the data voltage during the writing time period is the same, the ultimate electrical potential of the pixel electrode 118 is lower in the row with precharge. In other words, the gradation level of the pixel 111 with precharge is darker than that of the pixel 111 without precharge.

Figure 9:
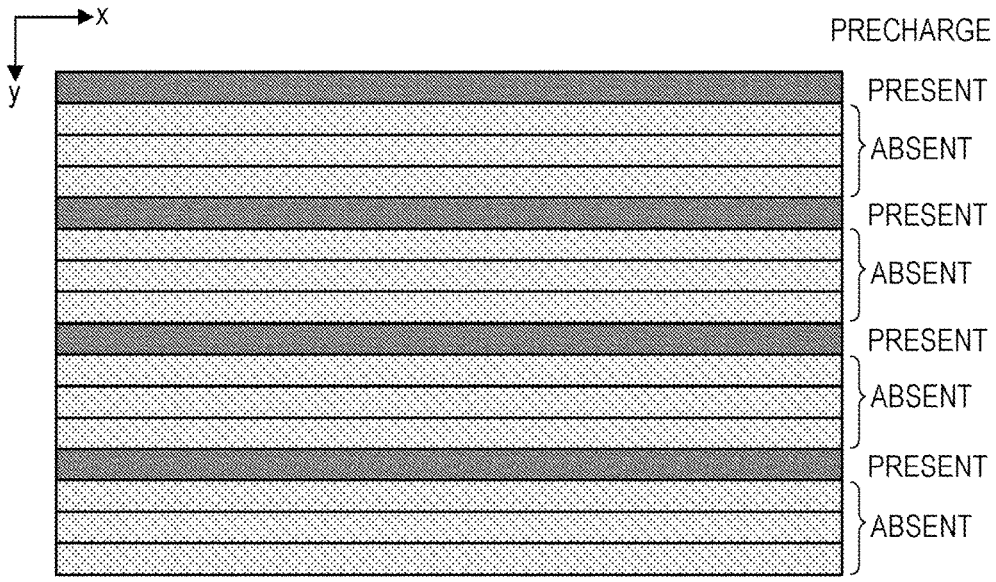
FIG. 9 is a diagram illustrating a disadvantage of thinning precharge.

FIG. 9 is a diagram illustrating a disadvantage of thinning precharge. Due to the reasons illustrated in FIGS. 7 and 8, even though data having entirely the same gradation level is written, the electrical potential of the pixel electrode 118 differs between the row with precharge and the row without precharge. In other words, the gradation level values of the row with precharge and the row without precharge are different from each other. In order to cope with the disadvantage, in the electro-optical device 1 of the embodiment, correction is performed with respect to at leasgradation level data voltage between the pixel in which precharge is performed and the pixel in which precharge is not performed, so as to minimize the difference therebetween. Hereinafter, a more specific operational example will be described.

2-2. Operational Example

Figure 10:
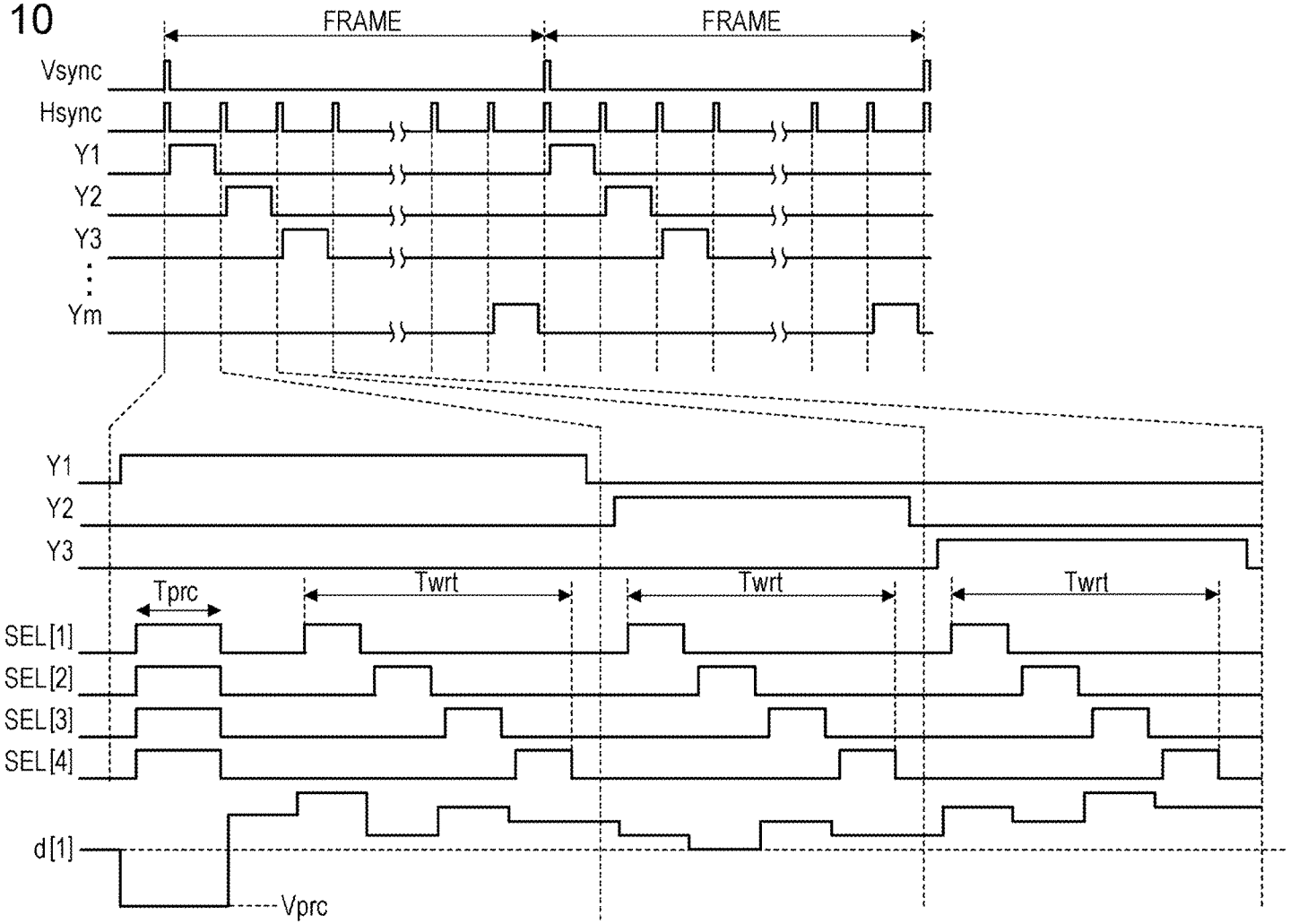
FIG. 10 is a timing chart illustrating an operation in Operational Example 1 of the electro-optical device.

FIG. 10 is a timing chart illustrating an operation in Operational Example 1 of the electro-optical device 1. Here, for descriptions, only the horizontal synchronizing signal Hsync, the selection signals SEL [1] to [4], the scanning signals Y1 to Y3, and a video signal d [1] are illustrated. The video signal d [1] is a video signal which is supplied to a video signal line 160 [1].

In this example, precharge is performed every four horizontal time period. All the horizontal time periods include the writing time period Twrt. In this example, the writing time period Twrt is a time period from when the selection signal SEL [1] is at a high level until when the selection signal SEL [4] is at a low level. The horizontal time period in which precharge is performed includes the precharge time period TPRC additionally. In this manner, the horizontal time period in which precharge is performed has a duration longer than the horizontal time period in which precharge is not performed.

2-2-1. Precharge

In the precharge time period TPRC, all the selection signals SEL [1] to [4] are at high levels. Therefore, the TFTs 152 [1] to [4] are all in the ON states, and a voltage is applied to the data lines 114 [1] to [4]. In this case, the level of the video signal d [1] which is output from the data line driving circuit 200 is a precharge voltage Vprc. In other words, a voltage applied to the data lines 114 [1] to [4] is the precharge voltage Vprc. The polarity of the precharge voltage Vprc is negative polarity at all times without depending on the polarity of the data voltage, and the magnitude thereof is uniform at all times. The magnitude of the precharge voltage Vprc is greater than the half a video amplitude, for example.

2-2-2. Writing

In this example, the selection signals SEL [1] to [4] are the signals to be at high levels in a sequentially exclusive manner. In order to prevent crosstalk between the adjacent data lines 114, a time exists in which both the selection signals SEL [1] and [2] are at low levels within a time period from when the selection signal SEL [1] is switched from a high level to a low level until when the selection signal SEL [2] is switched from a low level to a high level. In this manner, the data voltages are sequentially written to the data lines 114 [1] to [4] within writing time periods Tw1 to Tw4.

2-2-3. Correction

The correction circuit 510 corrects at least one data voltage between the row with precharge and the row without precharge. The correction is performed in order to minimize the gradation level difference therebetween when the same data voltage is written.

Figure 11:
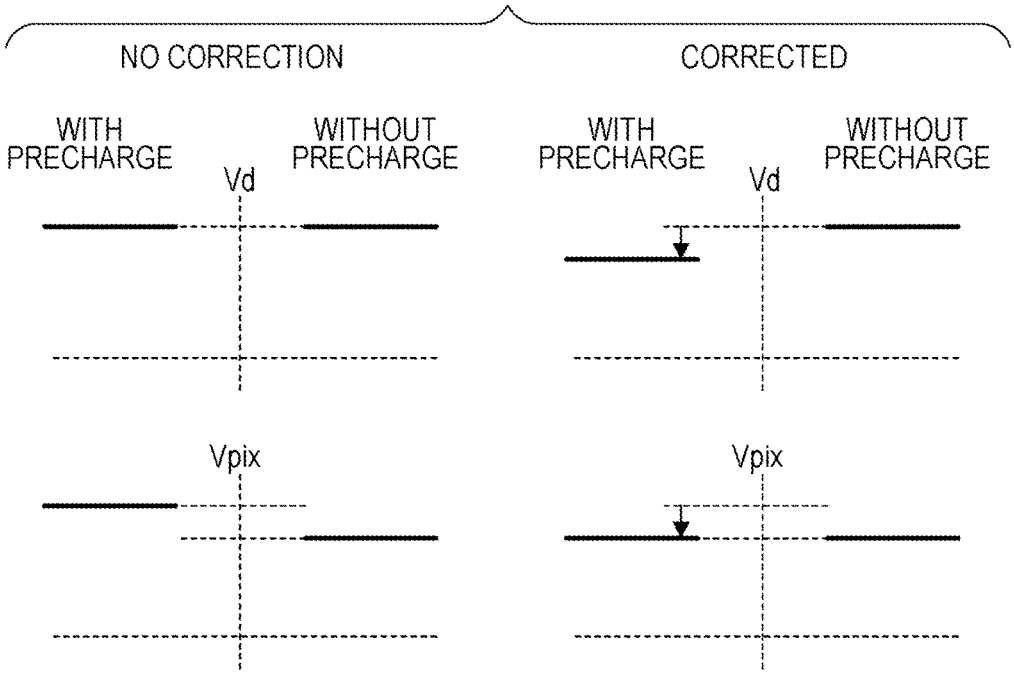
FIG. 11 is a diagram exemplifying correction of a data voltage.

FIG. 11 is a diagram exemplifying correction of the data voltage. In this example, the data voltage is positive polarity. The reference sign Vd represents the data voltage, and the reference sign Vpix represents the electrical potential of the pixel electrode 118 (will be the same in the following diagrams). In this example, when the data voltage is not corrected, as illustrated in FIG. 7, even though the same data voltage is applied, the electrical potential of the pixel electrode 118 is higher in the row with precharge (that is, bright in gradation level).

In this example, the correction circuit 510 performs correction of reducing the data voltage with respect to the data voltage of the pixel which belongs to the row with precharge. In other words, a negative correction value is added to the data voltage. No correction is performed with respect to the row without precharge. In this example, it is particularly effective when the gradation level is brighter in the row with precharge.

Figure 12:
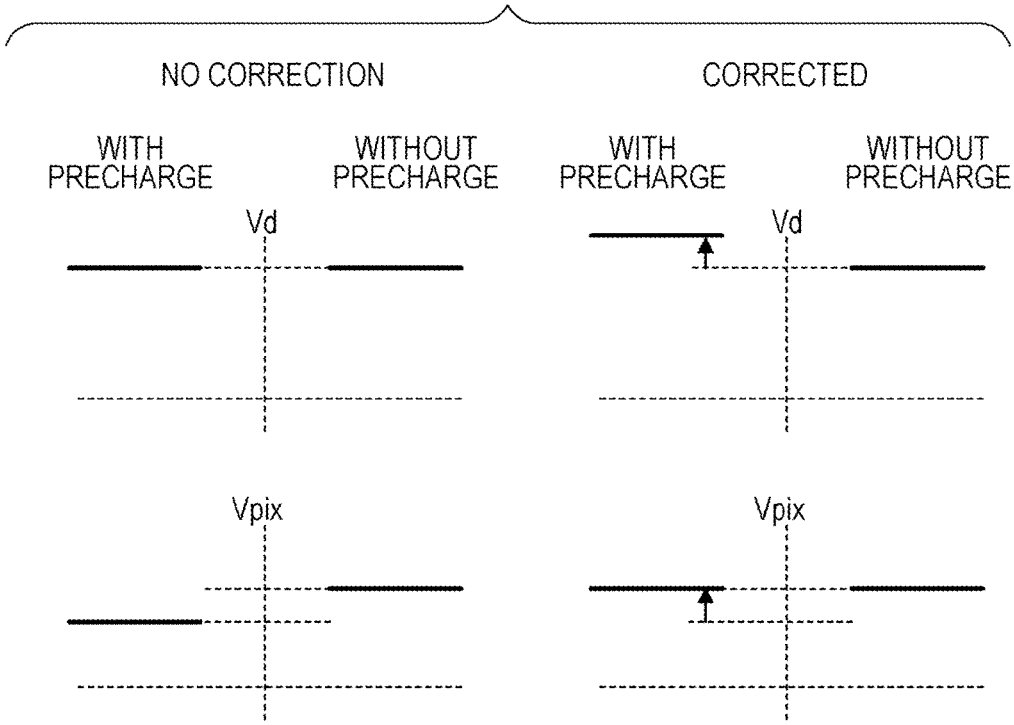
FIG. 12 is a diagram illustrating another example of correction of the data voltage.

FIG. 12 is a diagram illustrating another example of correction of the data voltage. In this example, the data voltage is positive polarity. In this example, when the data voltage is not corrected, as illustrated in FIG. 8, even though the same data voltage is applied, the electrical potential of the pixel electrode 118 is lower in the row with precharge (that is, dark in gradation level).

In this example, the correction circuit 510 performs correction of increasing the data voltage with respect to the data voltage of the pixel which belongs to the row with precharge. In other words, a positive correction value is added to the data voltage. No correction is performed with respect to the row without precharge. In this example, it is particularly effective when the gradation level is darker in the row with precharge.

Figure 13:
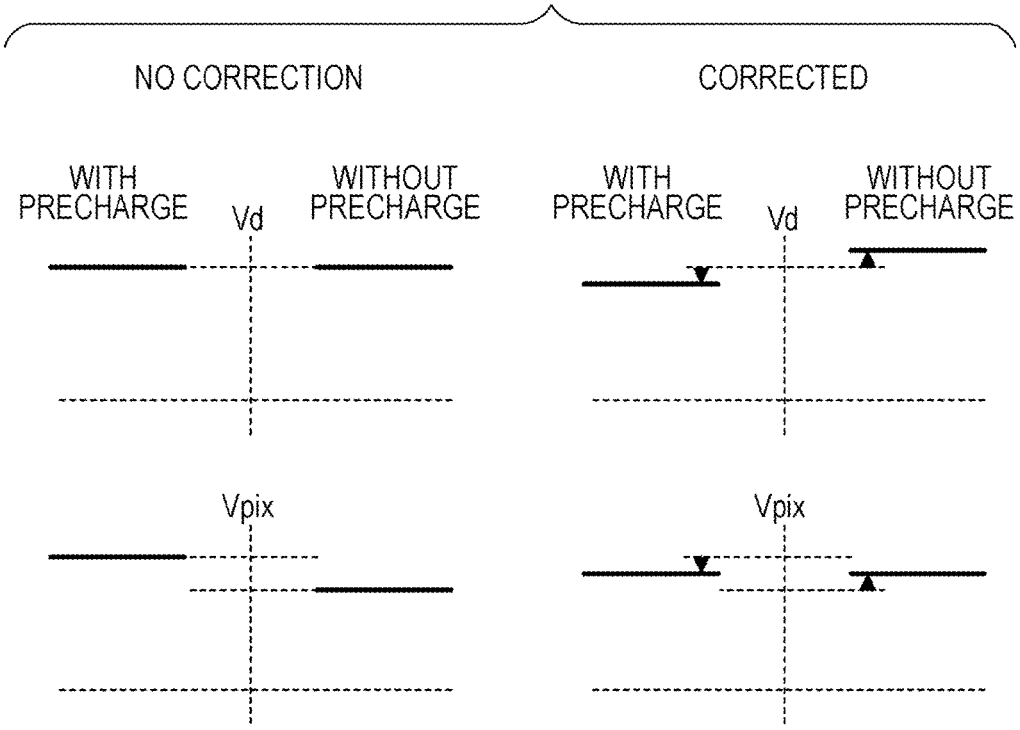
FIG. 13 is a diagram illustrating still another example of correction of the data voltage.

FIG. 13 is a diagram illustrating still another example of correction of the data voltage. In this example, the data voltage is positive polarity. In this example, when the data voltage is not corrected, as illustrated in FIG. 7, even though the same data voltage is applied, the electrical potential of the pixel electrode 118 is higher in the row with precharge (that is, bright in gradation level).

In this example, the correction circuit 510 performs correction of reducing the data voltage with respect to the data voltage of the pixel which belongs to the row with precharge, and performs correction of increasing the data voltage with respect to the data voltage of the pixel which belongs to the row without precharge.

In the examples of FIGS. 11 to 13, the correction data storage unit 511 stores the correction value of the data voltage with respect to the row with precharge, and the correction data storage unit 512 stores the correction value of the data voltage (in this example, zero, that is, no correction) with respect to the row without precharge. The selection unit 513 selects the correction data storage unit 511 for the pixel which belongs to the row with precharge and selects the correction data storage unit 512 for the pixel which belongs to the row without precharge. The adder 514 adds the correction value stored in the selected storage unit to the input data voltage.

The magnitude of the correction value is experimentally determined in accordance with the characteristics of the liquid crystal panel 100, for example. The correction circuit 510 may change the correction value (the correction amount) in accordance with the data voltage applied to the target pixel 111, for example. Specifically, the correction value may be increased as the data voltage increases.

In another example, the correction circuit 510 may change the correction value in accordance with the difference between the data voltage and the precharge voltage applied to the target pixel 111. Specifically, the correction value may be increased as the difference between the data voltage and the precharge voltage increases. In other words, the correction circuit 510 uses a greater correction value in a case where the difference between the data voltage Vd and the precharge voltage Vprc of the target pixel is V2 compared to in a case where the difference therebetween is V1 (however, V2>V1).

As described above, according to the embodiment, the gradation level difference between the row with precharge and the row without precharge can be reduced.

3. Application Example

Figure 14:
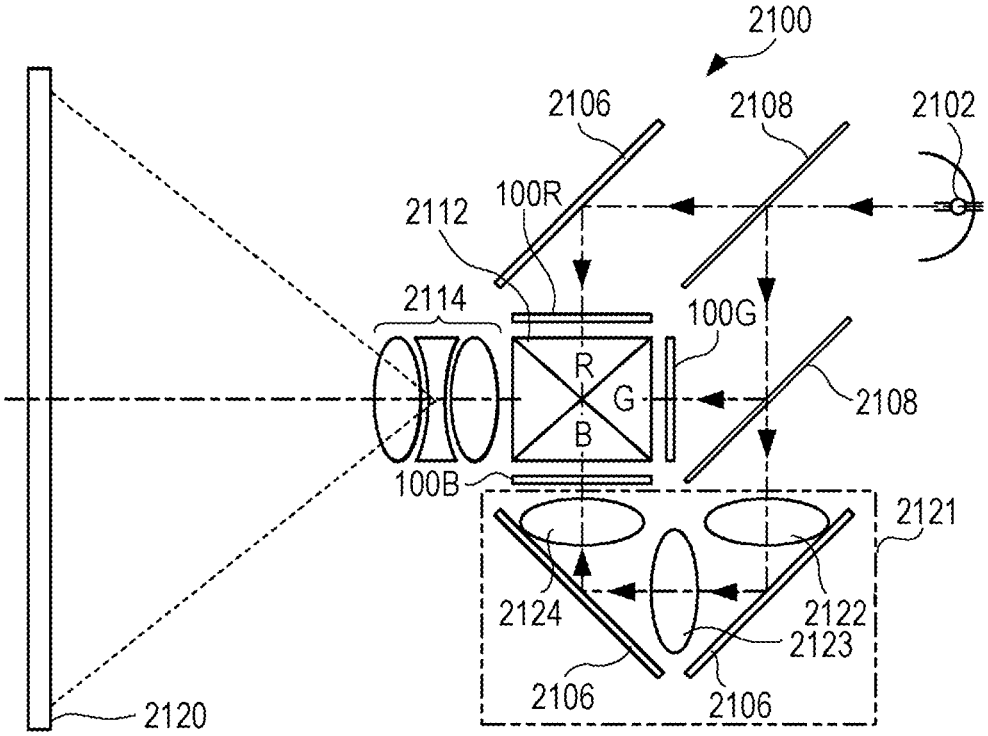
FIG. 14 is a diagram exemplifying a projector in the embodiment.

FIG. 14 is a diagram exemplifying a projector 2100 in the embodiment. The projector 2100 is an example of an electronic instrument which uses the electro-optical device 1. In the projector 2100, the electro-optical device 1 is used as a light bulb. As illustrated in the diagram, a lamp unit 2102 having a white light source such as a halogen lamp is provided inside the projector 2100. Projection light emitted from the lamp unit 2102 is separated into three primary colors of color R (red), color G (green), and color B (blue) by three mirrors 2106 and two dichroic mirrors 2108 which are arranged inside thereof. The separated rays of the projection light are introduced respectively to light bulbs 100R, 100G, and 100B corresponding to each of the primary colors. The light of the color B has a longer optical path when compared to other colors, which are the color R and the color G. Therefore, in order to prevent the loss thereof, the light of the color B is introduced via a relay lens system 2121 which includes an incident lens 2122, a relay lens 2123 and an emission lens 2124.

In the projector 2100, three sets of liquid crystal display devices including the electro-optical device 1 are provided so as to correspond respectively to the color R, the color G, and the color B. The configurations of the light bulbs 100R, 100G, and 100B are similar to those in the liquid crystal panel 100. In order to designate the gradation level of the primary color component in each of the color R, the color G, and the color B, the video signals are supplied respectively from external higher-level circuits, and each of the light bulbs 100R, 100G, and 100B is driven. The rays of light which are individually modulated through the light bulbs 100R, 100G, and 100B are incident on a dichroic prism 2112 from three directions. Then, the light of the color R and the color B is refracted by 90 degrees in the dichroic prism 2112, and the light of color G advances straight. Therefore, after images of the primary colors are synthesized, a color image is projected onto a screen 2120 by a projection lens group 2114.

Since the rays of light corresponding to the color R, the color G, and the color B are incident respectively on the light bulbs 100R, 100G, and 100B through the dichroic mirror 2108, there is no need to provide a color filter. Transmission images of the light bulbs 100R and 100B are projected after being reflected by the dichroic prism 2112, whereas a transmission image of the light bulb 100G is directly projected. Therefore, horizontal scanning directions of the light bulbs 100R and 100B are configured to be opposite to the horizontal scanning direction of the light bulb 100G so as to display images which are horizontally inverted.

4. Modification Examples

The invention is not limited to the above-described embodiment and various modifications can be executed. Hereinafter, some of Modification Examples will be described. Two or more Modification Examples described below may be combined and adopted.

4-1. Modification Example 1

Correction by the correction circuit 510 may be partially skipped. For example, when the data voltage is driven to be inverted in polarity every frame, correction may be performed in only the frame in which the precharge voltage and the data voltage are different from each other in polarity so as to perform no correction in the frame in which the precharge voltage and the data voltage are the same as each other in polarity. Meanwhile, when the data voltage is driven to be inverted in polarity every horizontal time period (one row), correction may be performed in only the row in which the precharge voltage and the data voltage are different from each other in polarity so as to perform no correction in the row in which the precharge voltage and the data voltage are the same as each other in polarity. In any case of the drive methods adopted, correction may be performed with respect to only the pixel in which the precharge voltage and the data voltage are different from each other in polarity so that no correction is performed with respect to the pixel in which the precharge voltage and the data voltage are the same as each other in polarity.

4-2. Modification Example 2

When precharge is performed partially only in the horizontal time periods, that is, when precharge is performed with respect to only the pixels 111 in partial rows, the row with precharge (that is, an arrangement of a particular pixel to which the precharge voltage is applied) may be switched every frame (that is, the row with precharge may be determined in rotation). For example, while having four frames as one unit, precharge may be performed targeting a (4i−3)th row in a first frame, a (4i−2)th row in a second frame, a (4i−1)th row in a third frame, and a 4ith row in a fourth frame. Moreover, the order (rotation) of the row with precharge may be switched every four frame. For example, in first four frames, precharge may be performed in the order of the (4i−3)th row, the (4i−2)th row, the (4i−1)th row, and the 4ith row, and in the successive four frames, precharge may be performed in the order of the (4i−2)th row, the (4i−1)th row, the 4ith row, and the (4i−3)th row.

4-3. Modification Example 3

Correction of the data voltage is not limited to the examples illustrated in FIGS. 11 to 13. For example, when the electrical potential of the pixel electrode 118 is higher in the row with precharge (brighter in gradation level), correction may be performed by increasing the data voltage of the row without precharge instead of reducing the data voltage of the row with precharge. In another example, when the electrical potential of the pixel electrode 118 is higher in the row without precharge (brighter in gradation level), correction may be performed by reducing the data voltage of the row without precharge instead of increasing the data voltage of the row with precharge. In still another example, when correction is performed in both the row with precharge and the row without precharge, correction may be performed by increasing the data voltage of the row with precharge, and reducing the data voltage of the row without precharge.

4-4. Modification Example 4

Figure 15:
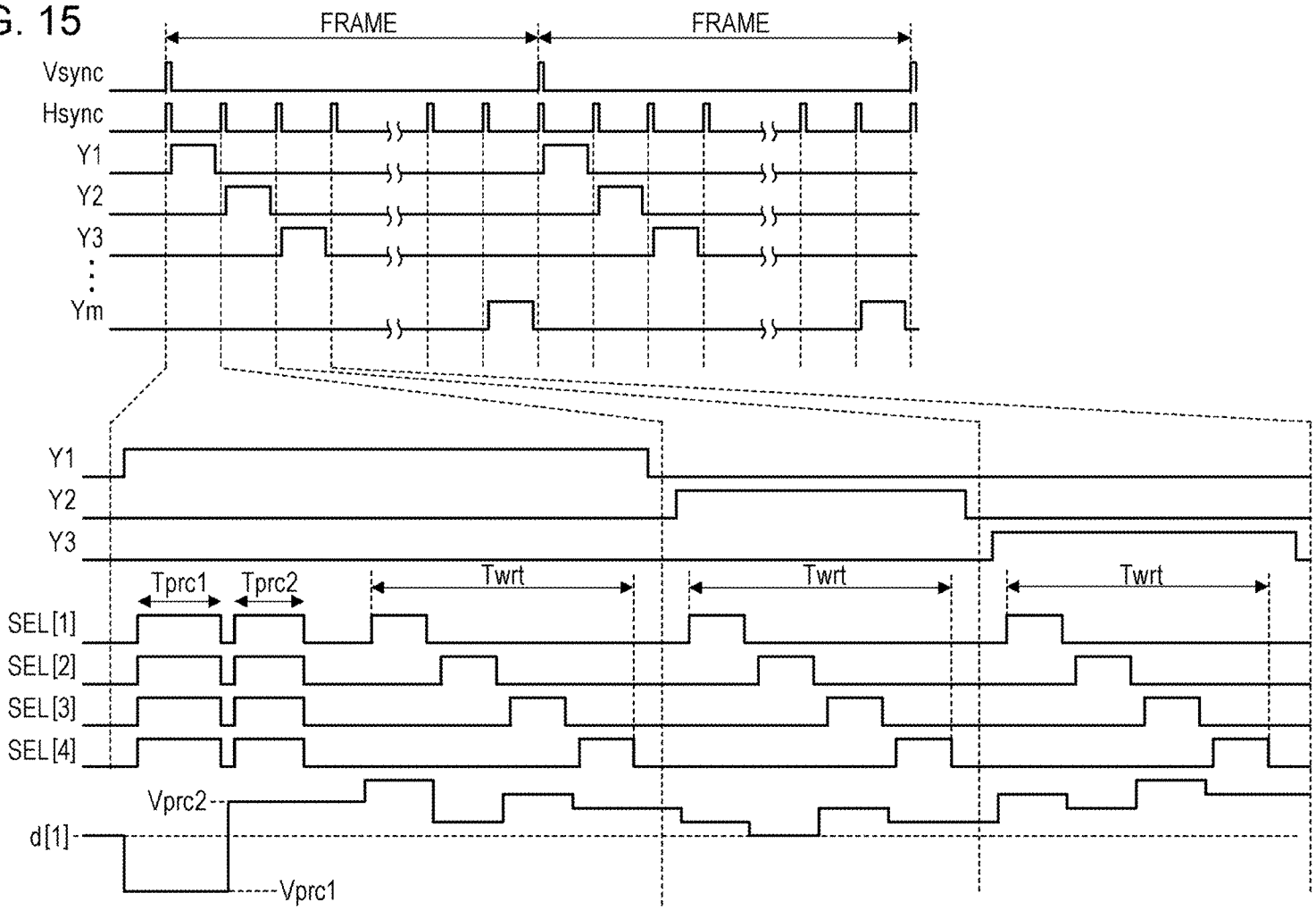
FIG. 15 is a timing chart illustrating an operation in Modification Example 4 of the electro-optical device.

FIG. 15 is a timing chart illustrating an operation in Modification Example 4 of the electro-optical device 1. In this example, precharge is performed in two stages of a first precharge time period Tprc 1 and a second precharge time period Tprc 2 within the horizontal time period with precharge. The first precharge time period Tprc 1 is similar to the precharge time period Tprc described in the embodiment. For example, a precharge voltage of negative polarity is applied thereto at all times without depending on the polarity of the data voltage. Within the second precharge time period Tprc 2, a precharge voltage of the same polarity as the data voltage is applied thereto.

Two stage-precharge is performed together with correction of the data voltage described in the embodiment, and thus, the gradation level difference between the row with precharge and the row without precharge can be reduced further.

4-5. Modification Example 5

Figure 16:
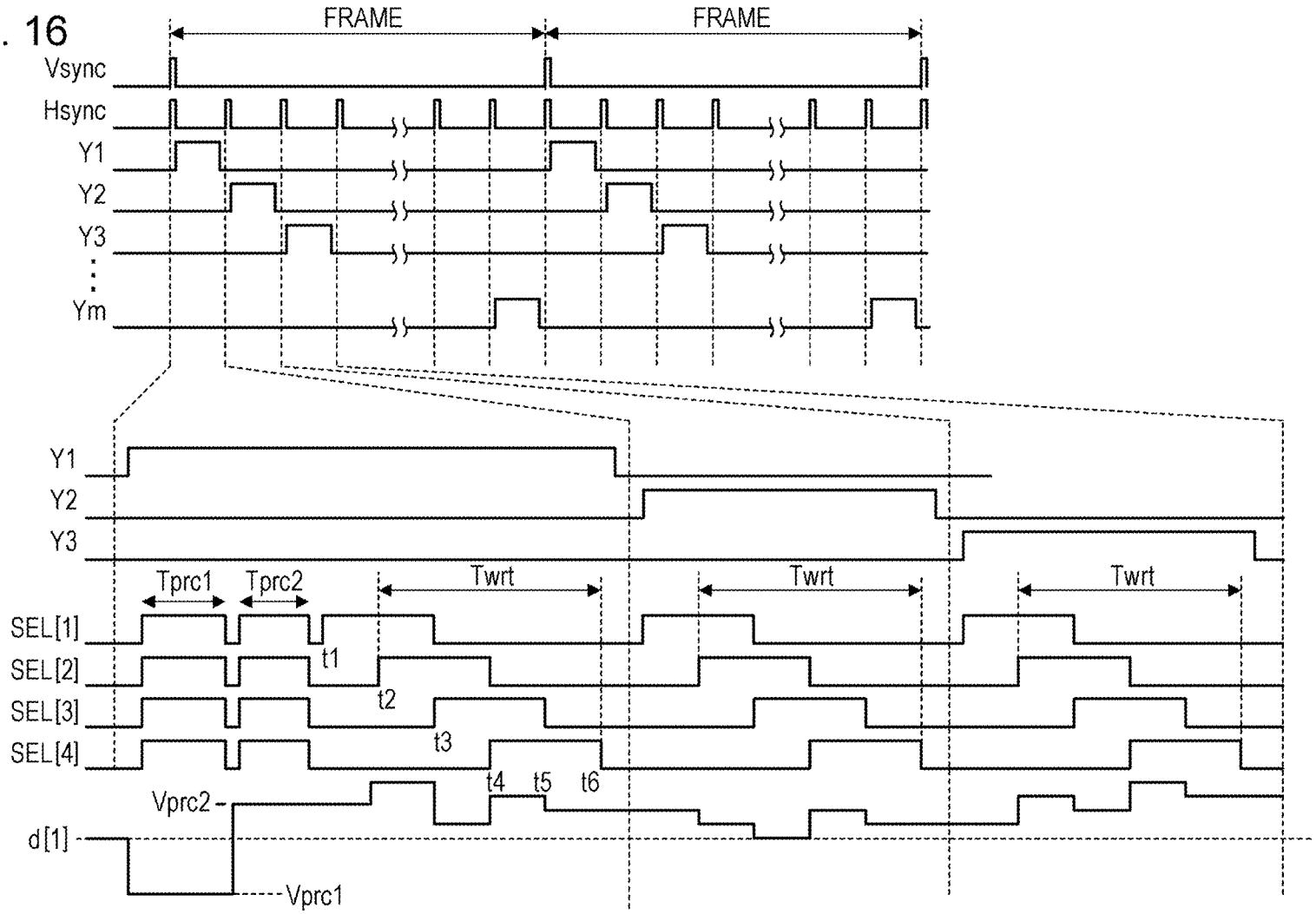
FIG. 16 is a timing chart illustrating another operation in Modification Example 4 of the electro-optical device.

FIG. 16 is a timing chart illustrating an operation in Modification Example 5 of the electro-optical device 1. In the example of FIG. 15, the selection signals SEL [1] to [4] are the signals to be at a high level in a sequentially exclusive manner. However, the selection signals SEL [1] to [4] may be signals to be at a high level simultaneously with other selection signals partially in the time period. For example, the selection signal SEL [1] is at a high level within times t1 to t3, and the selection signal SEL [2] is at a high level within times t2 to t4. In other words, both the selection signals SEL [1] and SEL [2] are at high levels during the times t2 to t3, and the data lines 114 [1] and 114 [2] are simultaneously selected. In this manner, as the selection time periods of the two adjacent data lines 114 overlap with each other, driving can be increased further in speed.

4-6. Other Modification Examples

The hardware configuration of the electro-optical device 1 is not limited to that described in the embodiment. For example, in the embodiment, descriptions are given regarding the configuration in which the driving circuit (the data line selection circuit 150) in a single unit outputs both the precharge voltage and the data voltage. However, the circuit outputting the precharge voltage and the circuit outputting the data voltage may be separate circuits. The correction circuit 510 may be a circuit separated from the control circuit 500.

The data lines 114 in the amount of n do not need to be divided every k line. In other words, when focusing on the partial data lines among the data lines 114 in the amount of n, the processing described in the embodiment may be performed with respect to the focused partial data lines.

In addition to the projector exemplified in the embodiment, electronic instruments adopting the electro-optical device 1 can be exemplified such as a television set, a view finder-type or direct-view monitor-type video tape recorder, a car navigation device, a pager, an electronic organizer, an electronic calculator, a word processor, a workstation, a TV phone, a POS terminal, a digital still camera, a portable phone, and an instrument provided with a touch panel.

The liquid crystal 115 is not limited to the VA liquid crystal. Liquid crystal other than the VA liquid crystal such as TN liquid crystal may be adopted. The liquid crystal 105 may be liquid crystal in a normally white mode. An electro-optical element other than the liquid crystal may be adopted. As the electro-optical element, a microcapsule-type electrophoresis display (EPD) and an electrochromic display (ECD) may be adopted in addition to liquid crystal.

The type of conduction of the semiconductor element (for example, the TFT 116), the signal (for example, the selection signal SEL) used in driving the semiconductor element, polarity of a voltage (for example, the precharge voltage), and the like are not limited to those described in the embodiment. The signal level and the voltage value described in the embodiment are merely examples.

The entire disclosure of Japanese Patent Application No. 2014-224972, filed Nov. 5, 2014 is expressly incorporated by reference herein.

What is claimed is:

1. An electro-optical device comprising:

a plurality of pixels that are provided so as to correspond to intersections of a plurality of scanning lines and a plurality of data lines, and present gradation levels in accordance with an electrical potential of a corresponding data line when a corresponding scanning line is selected;

a data line driving circuit that supplies, to a signal line, a video in which a data voltage having magnitude of voltage applied to k data lines (where k>1) among the plurality of data lines in accordance with an input video divided into frames is subjected to time division multiplexing;

a selection circuit that selects at least one data line which becomes a supply destination of the video signal supplied to the signal line among the k data lines;

a scanning line driving circuit that selects at least one scanning line among the plurality of scanning lines;

a control circuit that controls the selection circuit so as to select all the k data lines in a precharge time period before the data voltage in accordance with the video signal subjected to time division multiplexing is applied during a time period in which the scanning line corresponding to a particular pixel is selected in one frame, and controls a predetermined precharge voltage to be applied to the k data lines in the precharge time period; and a correction circuit that corrects a gradation level of at least one of a first pixel that is applied with the precharge voltage and a second pixel adjacent to the first pixel and that is not applied with the precharge voltage, to decrease a gradation level difference between the first pixel and the second pixel.

2. The electro-optical device according to claim 1, wherein the correction circuit changes a correction amount in correction in accordance with the data voltage applied to the at least one of the first pixel and the second pixel which becomes a correction target.

3. The electro-optical device according to claim 2, wherein the correction circuit increases the correction amount in a case where a difference between the data voltage of the at least one of the first pixel and the second pixel which becomes the correction target and the precharge voltage is a second voltage compared to a case where the difference therebetween is a first voltage that is less than the second voltage.

4. The electro-optical device according to claim 1, wherein the correction circuit performs correction so as to reduce the data voltage of the first pixel applied with the precharge voltage and to increase the data voltage of the second pixel that is not applied with the precharge voltage.

5. The electro-optical device according to claim 4, wherein the correction circuit performs correction with respect to the at least one of the first pixel and the second pixel in which polarities of the precharge voltage and the data voltage are different from each other, and performs no correction with respect to the at least one of the first pixel and the second pixel in which the polarities of the precharge voltage and the data voltage are the same as each other.

6. The electro-optical device according to claim 1, wherein the correction circuit performs correction so as to increase the data voltage of the first pixel applied with the precharge voltage and to reduce the data voltage of the second pixel that is not applied with the precharge voltage.

7. The electro-optical device according to claim 1, wherein the control circuit switches an arrangement of the particular pixel every frame.

8. A method of controlling an electro-optical device which includes a plurality of pixels that are provided so as to correspond to intersections of a plurality of scanning lines and a plurality of data lines, and present gradation levels in accordance with an electrical potential of a corresponding data line when a corresponding scanning line is selected, the method comprising:

supplying, to a signal line, a video signal in which a data voltage having magnitude of voltage applied to k data lines (where k>1) among the plurality of data lines in accordance with an input video divided into frames is subjected to time division multiplexing;

selecting at least one data line which becomes a supply destination of the video signal supplied to the signal line among the k data lines;

selecting at least one scanning line among the plurality of scanning lines;

controlling the selection circuit so as to select all the k data lines in a precharge time period before the data voltage in accordance with the video signal subjected to time division multiplexing is applied during a time period in which the scanning line corresponding to a particular pixel is selected in one frame, and controlling a predetermined precharge voltage to be applied to the k data lines in the precharge time period; and correcting a gradation level of at least one of a first pixel that is applied with the precharge voltage and a second pixel adjacent to the first pixel and that is not applied with the precharge voltage, to decrease a gradation level difference between the first pixel and the second pixel.

9. An electronic instrument which includes the electro-optical device according to claim 1.

10. An electronic instrument which includes the electro-optical device according to claim 2.

11. An electronic instrument which includes the electro-optical device according to claim 3.

12. An electronic instrument which includes the electro-optical device according to claim 4.

13. An electronic instrument which includes the electro-optical device according to claim 5.

14. An electronic instrument which includes the electro-optical device according to claim 6.

15. An electronic instrument which includes the electro-optical device according to claim 7.

16. The electro-optical device according to claim 1, wherein the first pixel is adjacent to the second pixel in a column direction.

* * * * *